US007464504B2

(12) United States Patent
Hartzell et al.

(10) Patent No.: US 7,464,504 B2
(45) Date of Patent: Dec. 16, 2008

(54) THERMAL PROTECTION APPARATUS AND METHOD FOR ISO CONTAINERS

(75) Inventors: Craig Hartzell, Morgantown, WV (US); Kevin Koch, Fairmont, WV (US); Zenovy Wowczuk, Morgantown, WV (US); John Ruth, Bruceton Mills, WV (US); Kenneth H. Means, Morgantown, WV (US); James E. Smith, Bruceton Mills, WV (US)

(73) Assignee: West Virginia University

( * ) Notice: Subject to any disclaimer, the term of this patent is extended or adjusted under 35 U.S.C. 154(b) by 0 days.

(21) Appl. No.: 11/703,367

(22) Filed: Feb. 7, 2007

(65) Prior Publication Data

US 2008/0184632 A1 Aug. 7, 2008

(51) Int. Cl.
*E04B 7/16* (2006.01)

(52) U.S. Cl. ..... 52/90.2; 52/79.1; 52/745.08; 52/79.13; 52/270; 52/656.1

(58) Field of Classification Search ..... 52/79.1, 52/79.9, 79.13, 90.1, 144, 173.3, 219, 262, 52/270, 271, 282.2, 282.5, 283, 284, 285.4, 52/406.1, 506.05, 515, 588.1, 592.1, 656.1, 52/704, 745.08, 750, 79.5; 318/74
See application file for complete search history.

(56) References Cited

U.S. PATENT DOCUMENTS

| | | | | |
|---|---|---|---|---|
| 665,642 | A | 1/1901 | Link | |
| 761,138 | A | 5/1904 | Bird et al. | |
| 1,808,829 | A | 6/1931 | Barnes | |
| 1,969,892 | A | 8/1934 | Lanyon | |
| 2,342,058 | A * | 2/1944 | Morris | 52/219 |
| 2,602,406 | A | 7/1952 | Orter | |
| 2,629,347 | A | 2/1953 | Wittrien | |
| 2,639,551 | A * | 5/1953 | McKee | 52/750 |
| 3,196,993 | A * | 7/1965 | Holloman | 52/282.5 |
| 3,458,788 | A * | 7/1969 | Ljung | 318/74 |
| 3,982,360 | A | 9/1976 | Newman | |
| 4,135,342 | A * | 1/1979 | Cotter | 52/406.1 |
| 4,182,406 | A | 1/1980 | Holbrook | |
| 4,189,988 | A | 2/1980 | Shaver | |

(Continued)

FOREIGN PATENT DOCUMENTS

| | | |
|---|---|---|
| FR | 2547397 | 12/1984 |

(Continued)

OTHER PUBLICATIONS

Hartman, Quinn D., Military ISO-Container Temperature Evaluation for U.S. Army Natick Research Development and Engineering Center(NRDEC), Final Report No. 93-17 Aug. 1996.

*Primary Examiner*—Richard E Chilcot, Jr.
*Assistant Examiner*—Matthew J Smith
(74) *Attorney, Agent, or Firm*—Gary J. Morris

(57) ABSTRACT

A thermal protection system for an ISO container includes roof panels attached to factory installed corner fittings on the container roof. The roof panels may be level or inclined and may include cavities for insulation. The standoff distance between the roof panels and the container roof is adjustable in certain embodiments. The roof panels may be layered to enhance thermal protection. Reflective coatings applied to the panels further enhance thermal protection from solar radiation.

7 Claims, 12 Drawing Sheets

U.S. PATENT DOCUMENTS

| | | | | | |
|---|---|---|---|---|---|
| 4,228,729 | A | | 10/1980 | Messick | |
| 4,373,308 | A | * | 2/1983 | Whittaker | 52/173.3 |
| 4,534,148 | A | | 8/1985 | Simpson et al. | |
| 4,548,002 | A | | 10/1985 | Murray | |
| 4,570,396 | A | | 2/1986 | Struben | |
| 4,620,397 | A | | 11/1986 | Simpson et al. | |
| 4,677,903 | A | | 7/1987 | Matthews | |
| 4,854,094 | A | * | 8/1989 | Clark | 52/79.1 |
| 4,911,317 | A | | 3/1990 | Schloesser et al. | |
| 5,353,601 | A | | 10/1994 | Palmer | |
| 5,368,056 | A | | 11/1994 | Riggi | |
| 5,487,247 | A | | 1/1996 | Pigg | |
| 5,575,119 | A | * | 11/1996 | Wolfowitz | 52/79.1 |
| 5,596,844 | A | * | 1/1997 | Kalinowski | 52/79.5 |
| 5,605,022 | A | | 2/1997 | Fulton | |
| 5,642,827 | A | | 7/1997 | Madsen | |
| 5,715,642 | A | * | 2/1998 | Buers | 52/656.1 |
| 5,735,639 | A | * | 4/1998 | Payne et al. | 52/90.1 |
| 5,862,633 | A | | 1/1999 | Ells | |
| 5,901,504 | A | | 5/1999 | Stoll | |
| 5,921,047 | A | * | 7/1999 | Walker | 52/282.2 |
| 5,987,910 | A | | 11/1999 | Koethe et al. | |
| 6,006,476 | A | * | 12/1999 | Zarnick | 52/144 |
| 6,155,008 | A | | 12/2000 | McKee | |
| 6,199,328 | B1 | * | 3/2001 | McGrath et al. | 52/506.05 |
| 6,250,022 | B1 | * | 6/2001 | Paz et al. | 52/262 |
| 6,685,012 | B2 | | 2/2004 | Bowden | |
| 6,780,099 | B1 | | 8/2004 | Harper | |
| 2002/0184830 | A1 | | 12/2002 | Bias | |
| 2003/0177703 | A1 | | 9/2003 | Forbis et al. | |

FOREIGN PATENT DOCUMENTS

| | | |
|---|---|---|
| JP | 56-091155 | 7/1981 |
| JP | 60-166525 | 8/1985 |
| WO | WO 9119864 | 12/1991 |

* cited by examiner

THERMAL PROTECTION APPARATUS AND METHOD FOR ISO CONTAINERS

BACKGROUND

The most common use of ISO containers has been to protect goods in transit either by truck, railroad or aircraft, however; such containers have found use as temporary shelters for personnel located in remote regions such as often experienced in military scenarios. While the containers provide a structurally robust shelter for humans, the environmental conditions inside the containers are often far from desirable for human occupancy, mainly due to lack of internal temperature control. Containers located in direct sunlight can easily experience internal temperatures well above 100 degrees Fahrenheit if no thermal abatement means are implemented such as air conditioning, active ventilation, or passive shading. Cargo transportation also often utilizes ISO containers frequently housing perishable items such as food that will spoil rapidly in high temperature environments. A useful way to thermally protect ISO containers is to add roof panels above the container roof.

DETAILED DESCRIPTION OF EMBODIMENTS OF THE INVENTION

Figure 1:
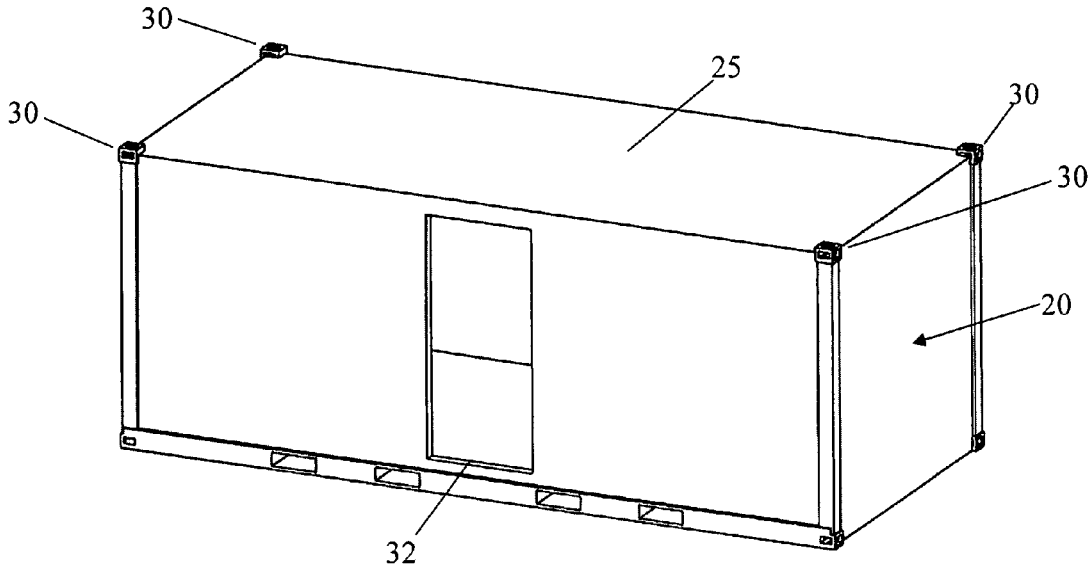
FIG. 1 shows the ISO container to be thermally protected.
Figure 2:
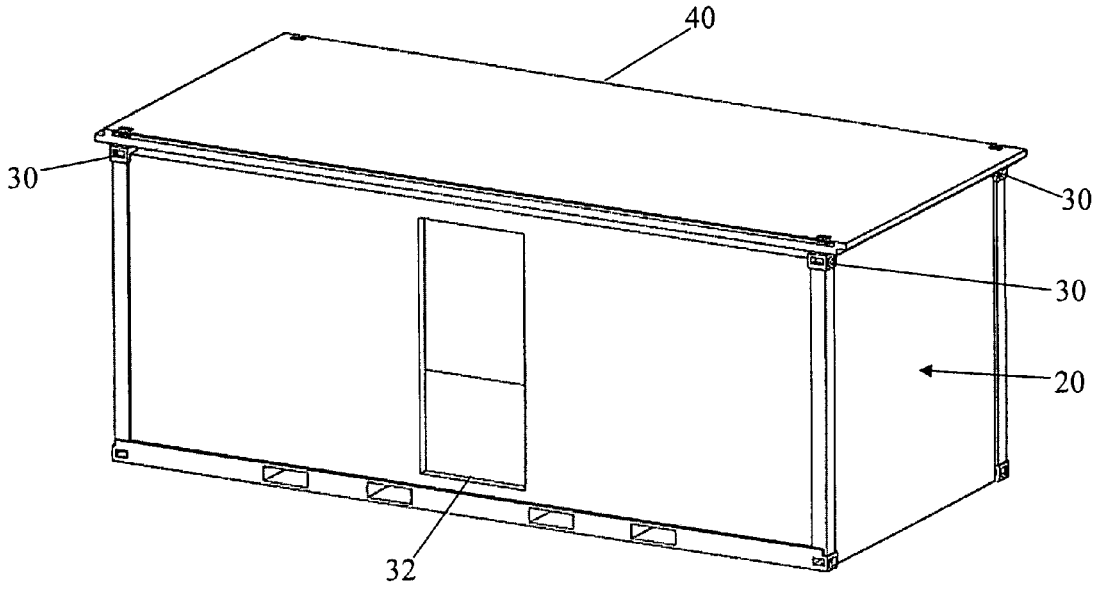
FIG. 2 shows the ISO container with a single roof panel to provide thermal protection.
Figure 3:
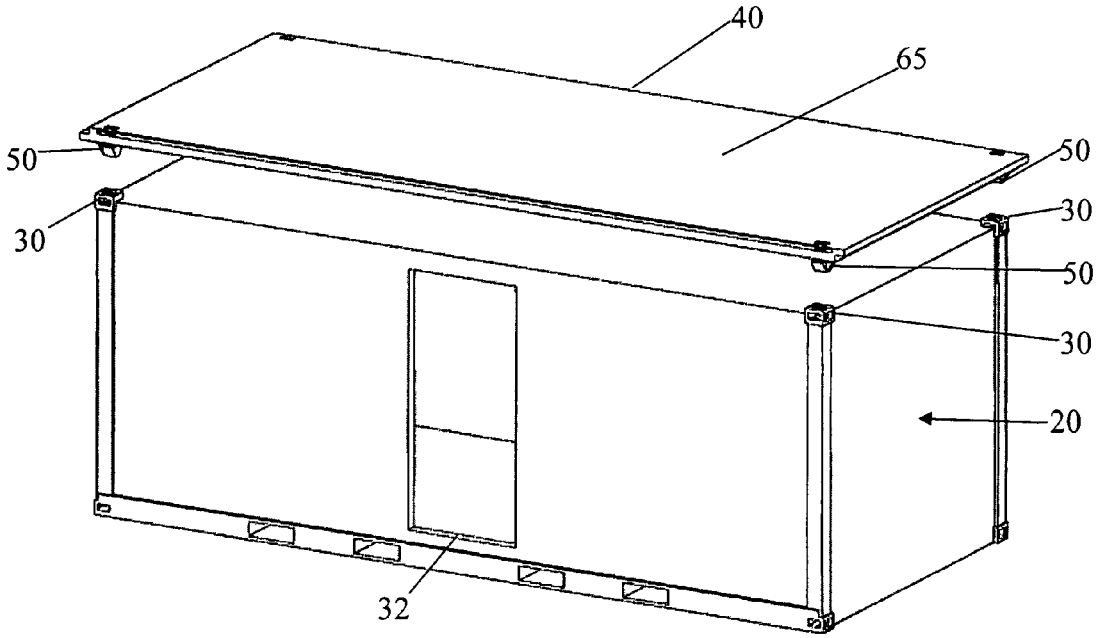
FIG. 3 shows the ISO container with a single roof panel with attachment roof panel anchors and corner fittings.
Figure 4:
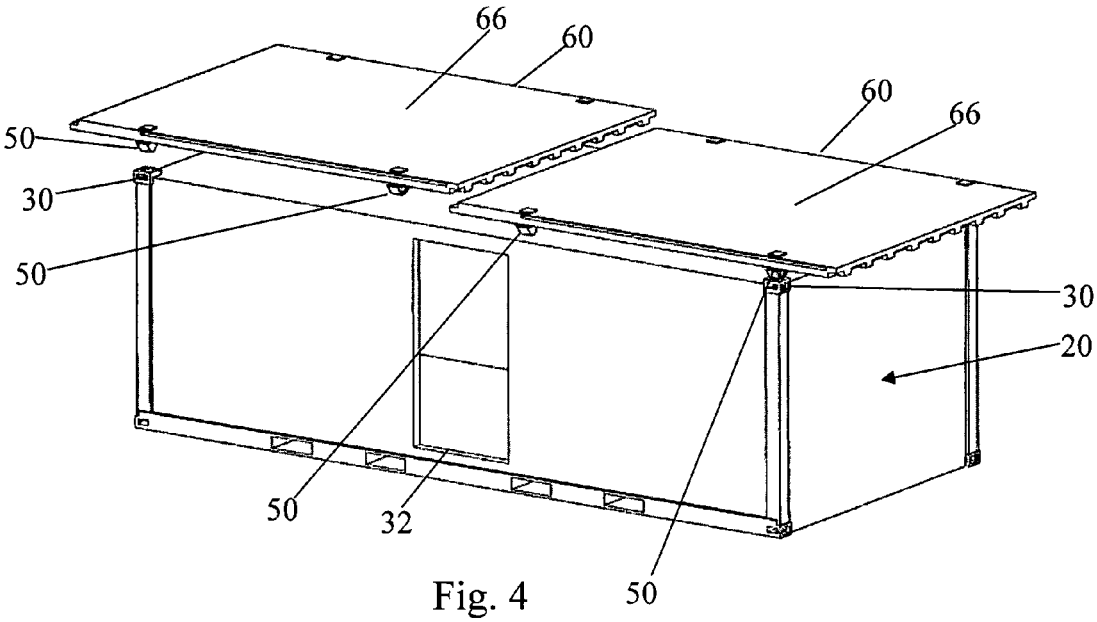
FIG. 4 shows the ISO container with multiple interlocking roof panels to provide thermal protection.

An ISO container 20 as shown in FIG. 1 is a standardized metallic enclosed structure having a floor, a roof, four walls and at least one door all with specified dimensions and design attributes. Common standard dimensions of ISO containers include but are not limited to length dimensions of 20, 40, 45, 48, and 53 feet, width dimension of 8 feet, and height dimensions of 8.5 feet and 9.5 feet. The containers have four standard, factory installed, corner fittings 30 on the upper surface 25 of the container roof to lift and position the containers during transport. One embodiment of a door 32 in an ISO container 20 is illustrated in FIG. 1. As shown in FIG. 2, to provide thermal protection within the ISO container 20, a roof panel system is employed where at least one roof panel 40 is removably affixed to an ISO container 20 via the corner fittings 30 on the ISO container 20 as shown in FIG. 3. In one embodiment, roof panel anchors 50 affixed to the roof panel 40 are inserted into corner fittings to secure the roof panel to the ISO container 20. The roof panel anchors 50 may be released from the corner fittings 30 to permit separation of the roof panel 40 and the ISO container 20. The roof panel anchors 50 comprise at least one spring loaded tab in one embodiment and twist lock fasteners in another embodiment to removably engage the roof panel anchors 50 to the corner fittings 30. The twist lock fasteners engage the corner fittings 30 with tabs when twisted in a preferential direction and disengage the tabs in the corner fittings 30 when twisted in the opposite direction. The roof panels 40 are constructed of materials such as but not limited to plastic, metal, fiber reinforced composite material, wood products and wood by-products, polymers, and recycled materials. More than one roof panel 60 may be needed to fully cover the ISO container roof upper surface 25 as illustrated in FIG. 4. In some embodiments the thermal protection of the ISO container 20 is provided by shading of the ISO container 20 by the roof panels 40 and 60 from direct sunlight. The upper surfaces 65 and 66 of the roof panels 40 and 60 respectively, may be coated with a highly reflective coating, such as but not limited to, aluminized paint, white paint, silver paint, or similar coating intended to reflect incident solar radiation. The lower surface 67 of the roof panel may be coated with a low emissivity coating such as but not limited to white paint, aluminized paint, or silver paint, in one embodiment to reduce radiation heat transfer from the roof panel 60 to the roof of the ISO container 20. Similar coatings may be applied to the lower surface of roof panel 40 for the single panel embodiment.

Figure 5:
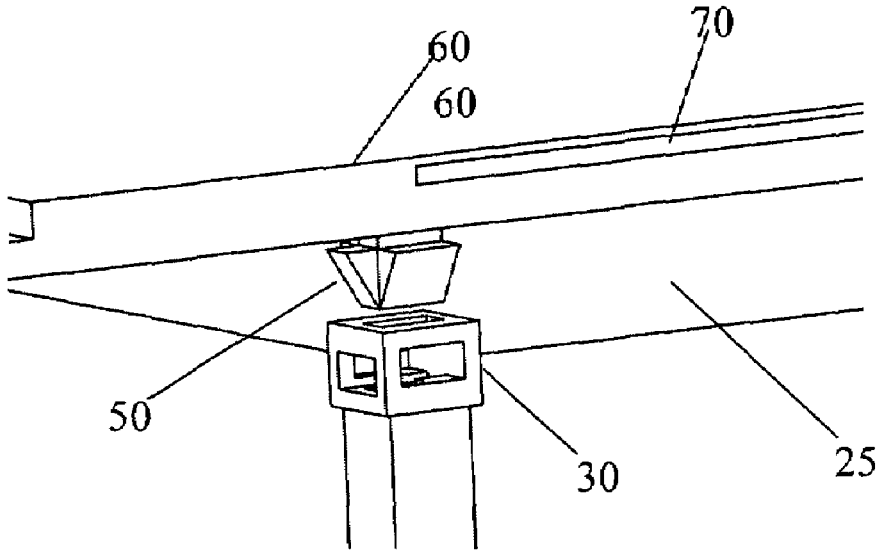
FIG. 5 shows a detailed view of the roof panel anchor and the ISO container corner fitting.

FIG. 5 shows an expanded view of the roof panel anchor 50 prepared to be inserted into a corner fitting 30. The roof panel anchor 50 removably attaches to the corner fitting 30 through retractable tabs on the anchor 50 in one embodiment.

Figure 6:
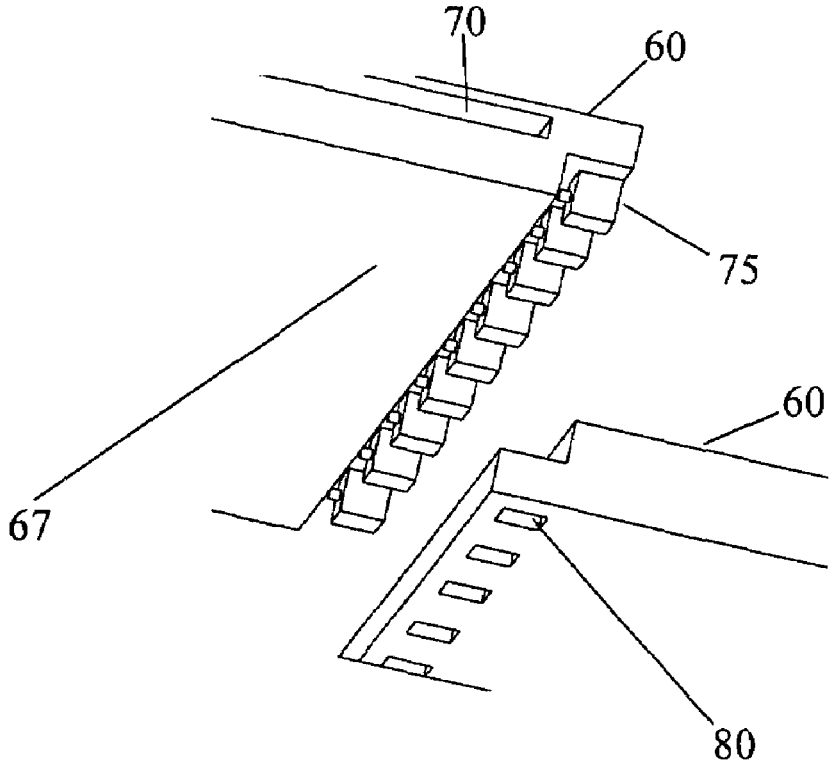
FIG. 6 shows one embodiment of a roof panel interlocking system.

FIG. 6 illustrates an embodiment of an interlocking system such that the modular roof panels 60 may be adjoined to form an integrated larger panel. One end of a first roof panel has a male tab pattern 75 configured to mate with a female pattern 80 located on the end of a second roof panel to interlock the adjoining panels. In one embodiment, the roof panels 60 have one end configured with a male tab pattern 75 and the opposite end is configured with the mating female pattern 80 forming identical modular roof panels with interlocking capability.

In one embodiment, at least one insulation cavity 70 between the upper surface 66 of the roof panel 60 and the lower surface 67 of the roof panel 60 provides access for insertion of thermal insulation materials as needed to augment the thermal protection of the ISO container 20 afforded by the roof panel 60. A similar insulation cavity may be included in the single roof panel 40.

Figure 7:
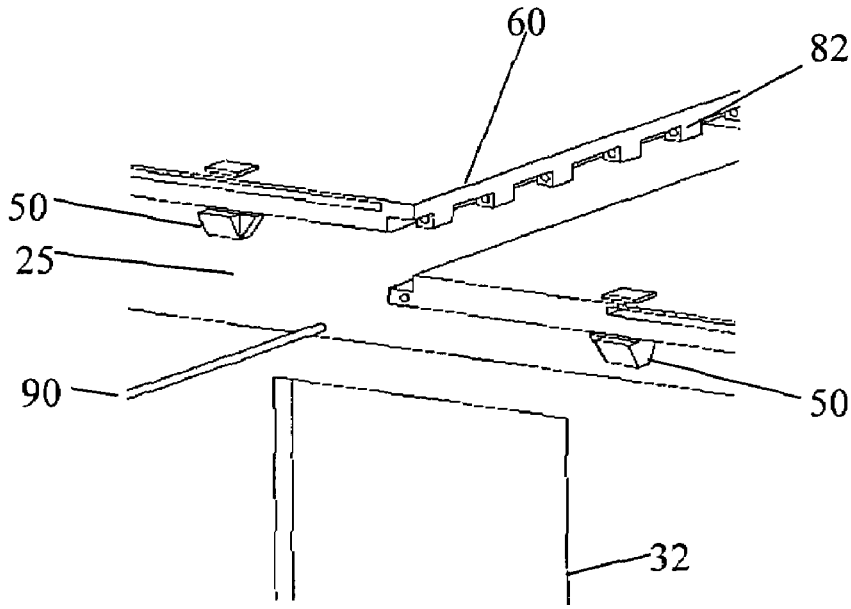
FIG. 7 shows a second embodiment of a roof panel interlocking system.
Figure 8:
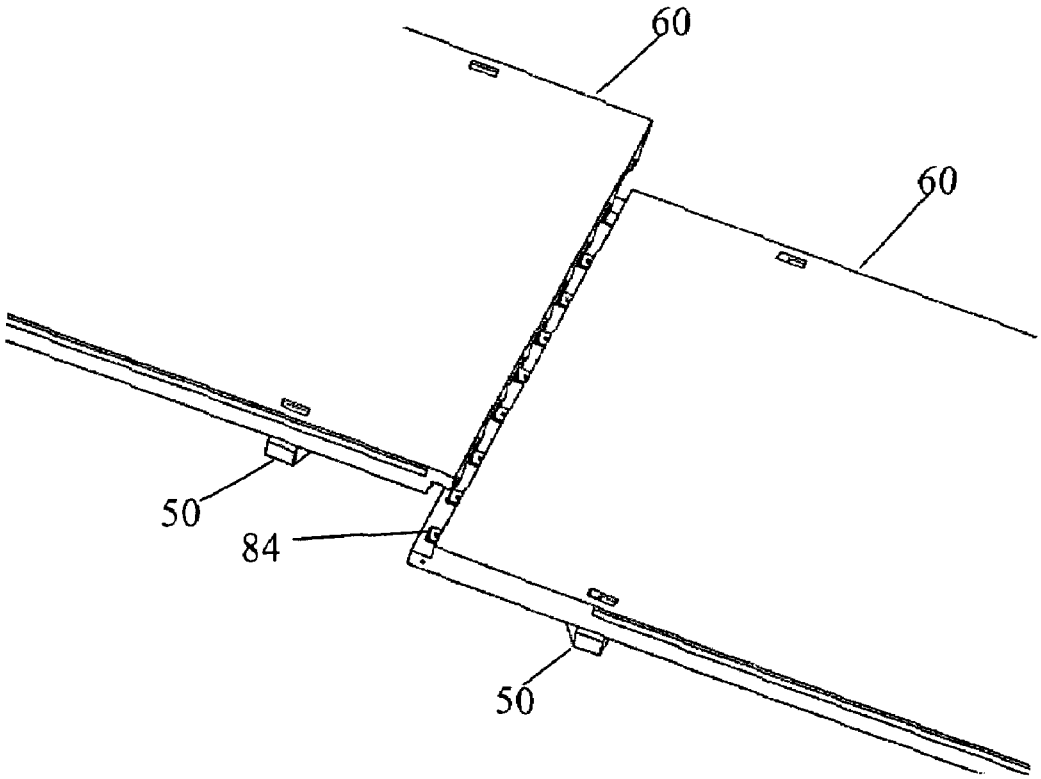
FIG. 8 shows detail of the second embodiment of a roof panel interlocking system.

FIG. 7 and FIG. 8 show another embodiment of interlocking a plurality of roof panels 60 whereby the interlocking male tab 82 and female pattern 84 are further secured by a pin 90 passed into lateral holes extending through the joint of the panels.

Figure 9:
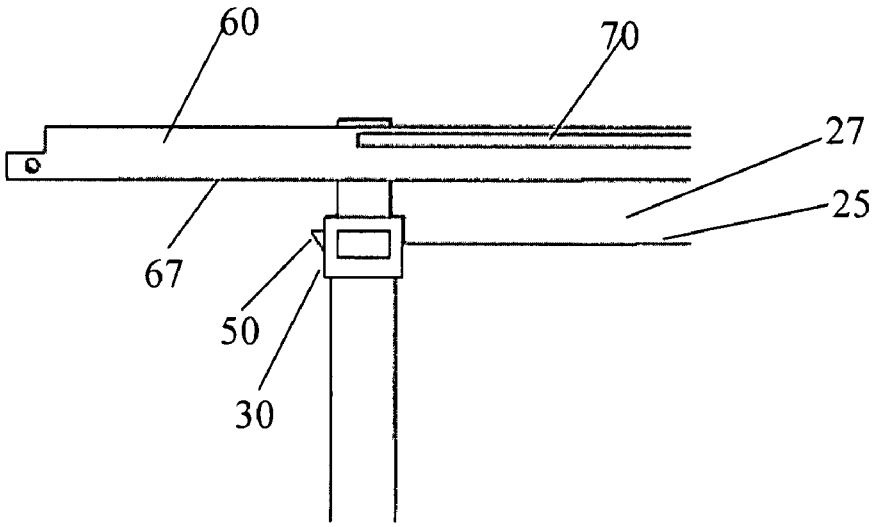
FIG. 9 shows a roof panel affixed to the ISO container with overhanging roof portion and a standoff distance between the roof panel and ISO container roof.
Figure 10:
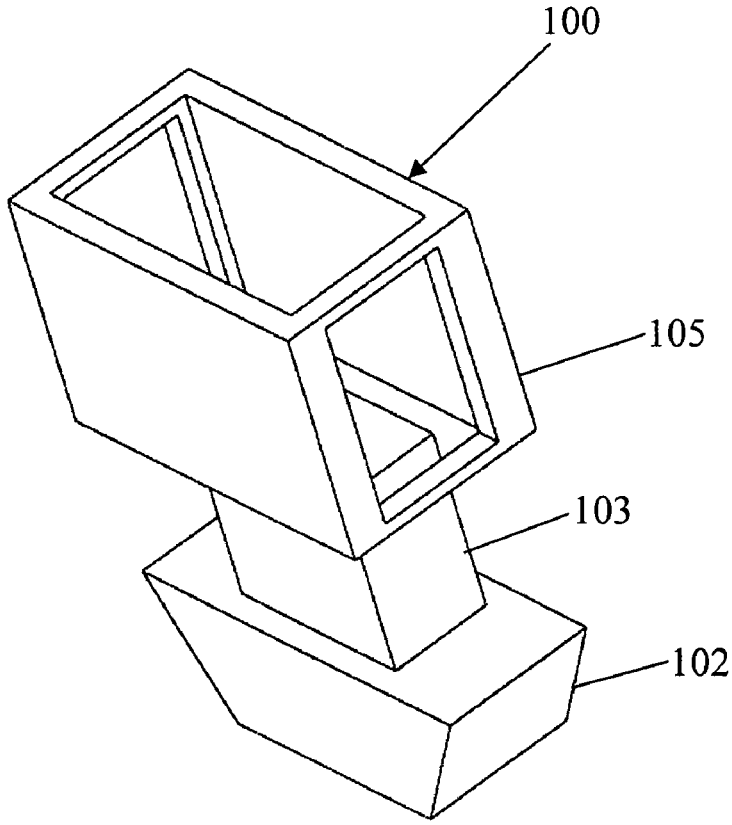
FIG. 10 shows a corner block spacer.
Figure 11:
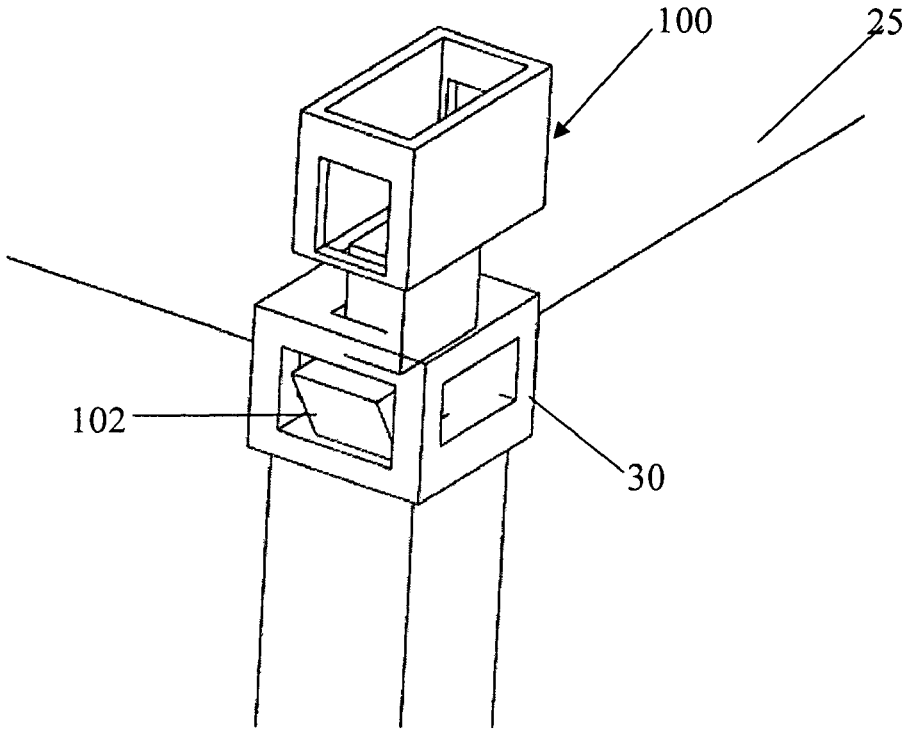
FIG. 11 shows a corner block spacer inserted into a corner fitting on an ISO container.

FIG. 9 illustrates a roof panel 60 positioned above an ISO container roof upper surface 25 with a standoff distance 27 between the ISO container roof upper surface 25 and the roof panel bottom surface 67. Comer spacer blocks 100 (FIG. 10 and FIG. 11) are used in one embodiment to maintain the roof panel level with respect to the ISO container roof upper surface 25. Each corner spacer block 100 has one roof panel anchor 102 attached to one end of a support bar 103 and a corner fitting-shaped receptacle 105 attached to the opposite end of the support bar 103. Each corner spacer block 100 is inserted into an ISO container corner fitting 30 and a roof panel anchor 50 is inserted into a corner fitting-shaped receptacle 105 on the spacer block 100.

Figure 12:
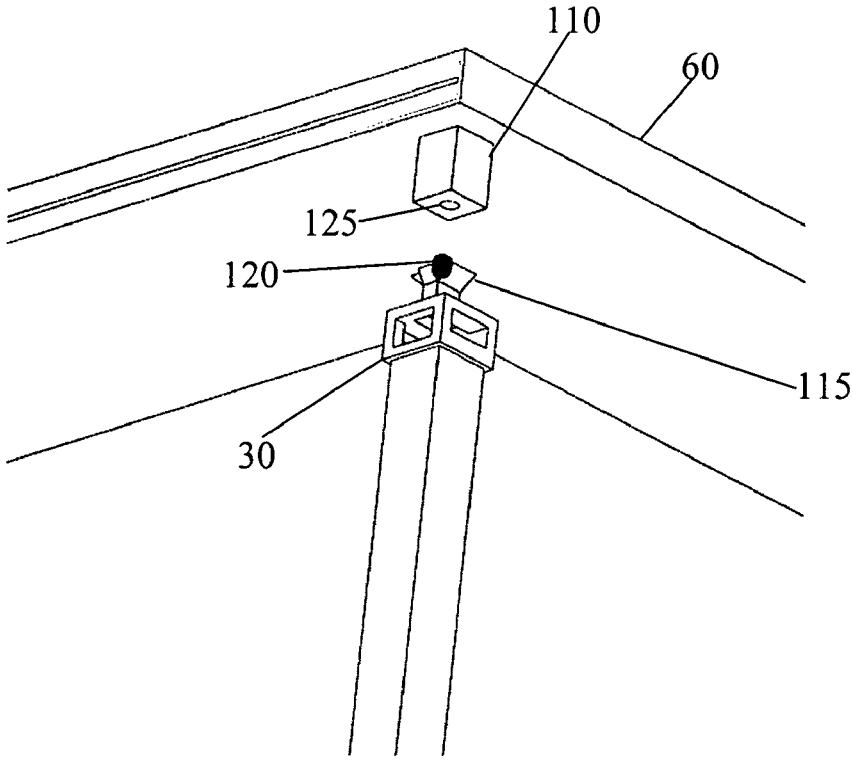
FIG. 12 shows one simple screw-jack embodiment of a roof panel anchor to adjust the spacing between the roof panel and ISO container roof.

Adjustments to the standoff distance 27 can be made by a screw-type adjuster in one embodiment of the invention as is shown in FIG. 12. An anchor 115 has a screw 120 fixed to its top surface which screws into a threaded hole 125 in a support block 110 attached to a roof panel 60 or 40. By rotation of the anchor 115 and screw 120 and by insertion of the anchor 115 into a corner fitting 30, the standoff distance 27 between the roof panel 60 and the upper surface of the ISO container roof 25 may be adjusted and fixed.

Figure 13:
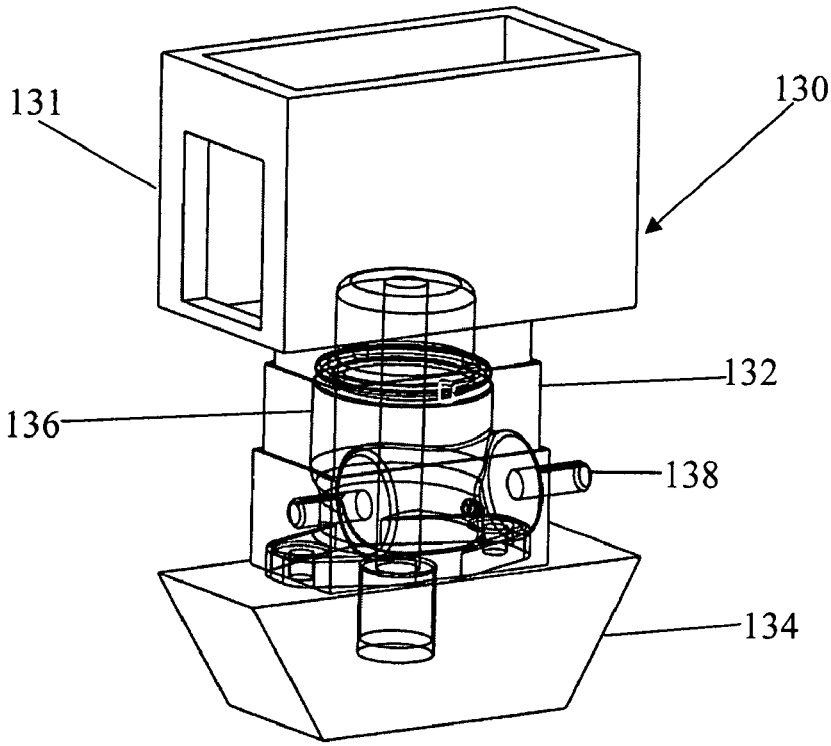
FIG. 13 shows an enclosed gear-box screw-jack within a telescoping corner spacer block to adjust the spacing between the roof panel and ISO container roof.

In another embodiment shown in FIG. 13, the standoff distance 27 can be adjusted through a telescoping corner block 130 with an internal screw-jack 136 to lengthen or shorted the telescoping section 132. The telescoping section 132 connects an anchor 134 and corner fitting-type receptacle 131. Rotation of the shaft 138 extending from the screw-jack 136 shortens or lengthens the telescoping section 132 depending on the direction of rotation of the shaft 138. By inserting a roof panel anchor into the corner fitting-type receptacle 131 and by inserting the anchor 134 into a corner fitting 30 on the ISO container 20, a roof panel 60 or 40 is attached to the ISO container 20 with a pre-set or further adjustable standoff distance 27.

Figure 14:
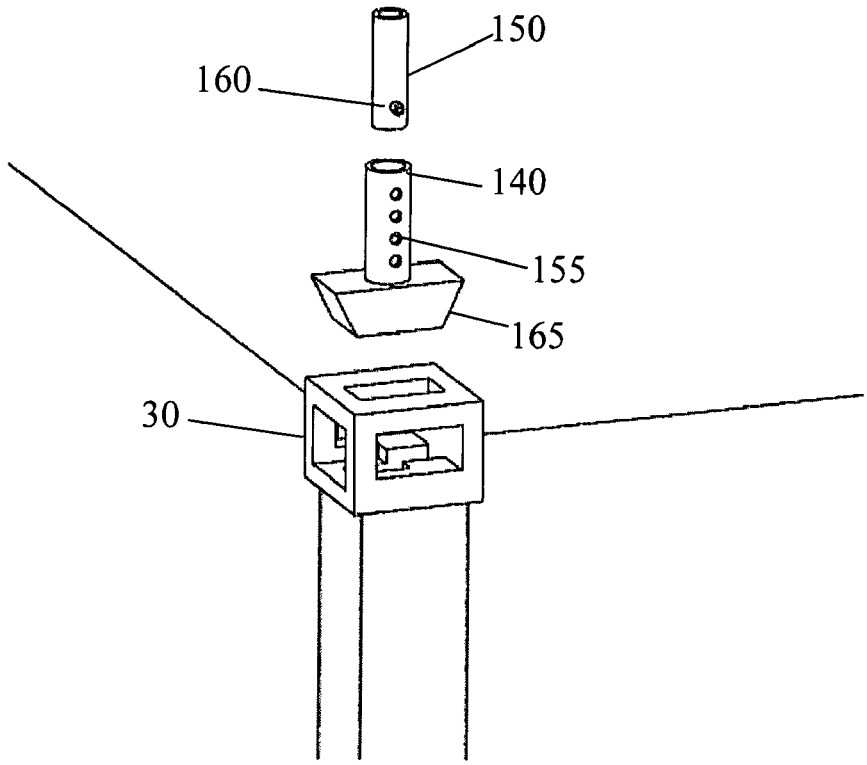
FIG. 14 shows a sleeve and post mechanism to adjust the spacing between the roof panel and the ISO container roof.

FIG. 14 illustrates an embodiment to provide adjustment of the standoff distance 27 between the ISO container roof upper surface 25 and the lower surface 67 of the roof panel 60 (or 40). A concentric sleeve and post mechanism is used whereby the post 150, affixed to the roof panel 60 slides within the sleeve 140, the sleeve 140 is attached to a roof panel anchor 165. Longitudinally spaced, transverse holes 155 in the sleeve 140 through which a locking pin 160 may be positioned permits relative positioning of the sleeve 140 and post 150, thereby providing adjustment of the standoff distance 27 between the ISO container roof upper surface 25 and the lower surface 67 of the roof panel 60 (or 40).

Figure 15:
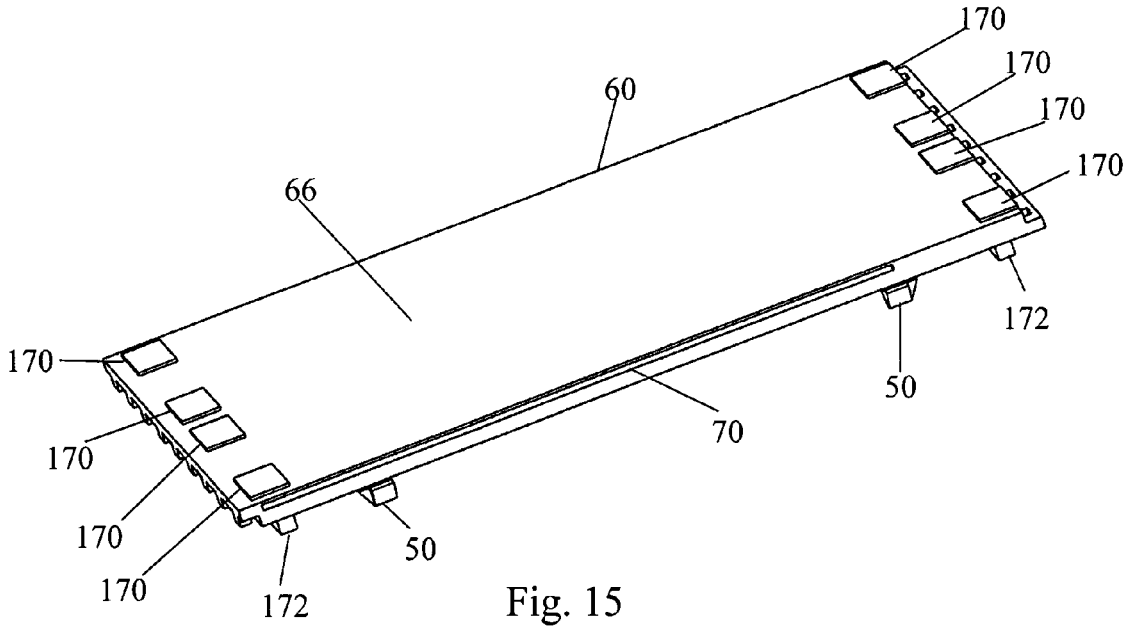
FIG. 15 shows the upper surface of a roof panel equipped with solar panels.
Figure 16:
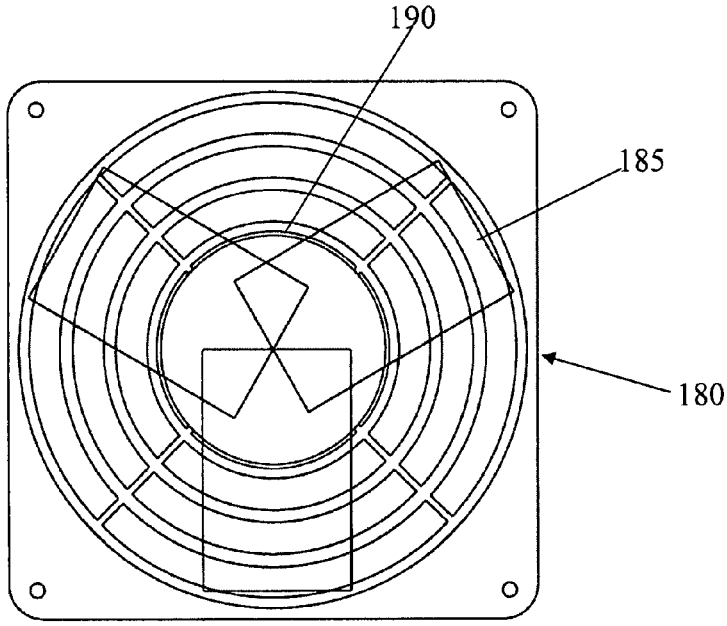
FIG. 16 shows an electric powered fan to create air movement within air gaps adjacent to the roof panels.

On the upper surface 66 of the roof panel 60, are positioned solar cells in at least one embodiment (FIG. 15) to convert a portion of the incident solar radiation on the panel to electrical energy that may be used to drive a ventilation fan 180 shown in FIG. 16. The ventilation fan 180 having fan blades 185 and electric motor 190 driving the blades 185 may be positioned to move air between the ISO container roof upper surface 25 and the roof panel 60 or between stacked roof panels (FIG. 19) positioned on top of the ISO container 20. Similar embodiments may be used on roof panel 40.

In at least one embodiment, the roof panel 40 is positioned above the ISO container roof 25 such that a standoff distance 27 provides an air gap between the lower surface 67 of the roof panel 60 and the ISO container roof upper surface 25 (FIG. 8). The air gap within the standoff distance 27 enhances thermal protection of the ISO container 20 by providing a layer of thermal insulation.

Figure 17:
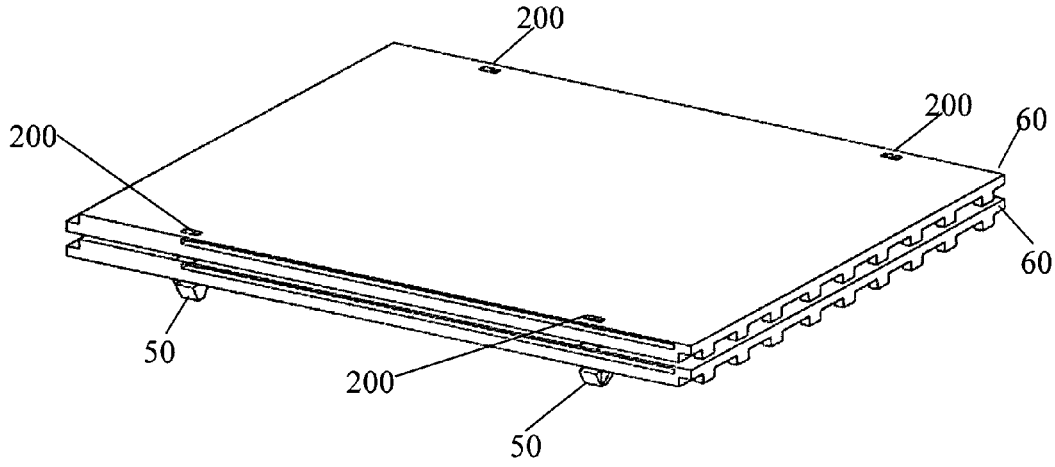
FIG. 17 shows a plurality of roof panel layers to provide enhanced thermal protection.
Figure 18:
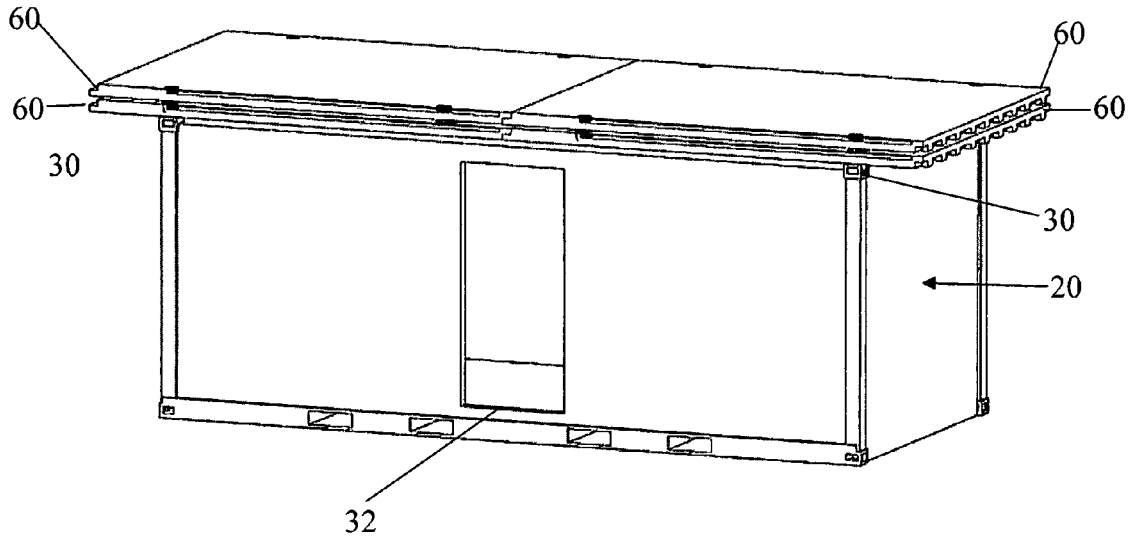
FIG. 18 shows a plurality of roof panel layers interlocked to form a thermally protective barrier of an ISO container.

In another embodiment, thermal protection of the ISO container may be enhanced by layering the roof panels 60 as shown in FIG. 17 where the roof panels 60 are stacked on top of each other. In this embodiment, the roof panels 60 further comprise roof panel anchor receptacles 200 such that the roof panels 60 may be removably engaged in a stacked manner. It this embodiment, the roof panel anchors 50 engage into the roof panel anchor receptacles 200 to form a layered roof panel comprising a plurality of roof panels 60 with roof panel anchor receptacles 200. Normally two or more roof panel anchor receptacles are used to secure layered panels. The roof panels 40 may also be stacked in this manner in one embodiment.

Figure 19:
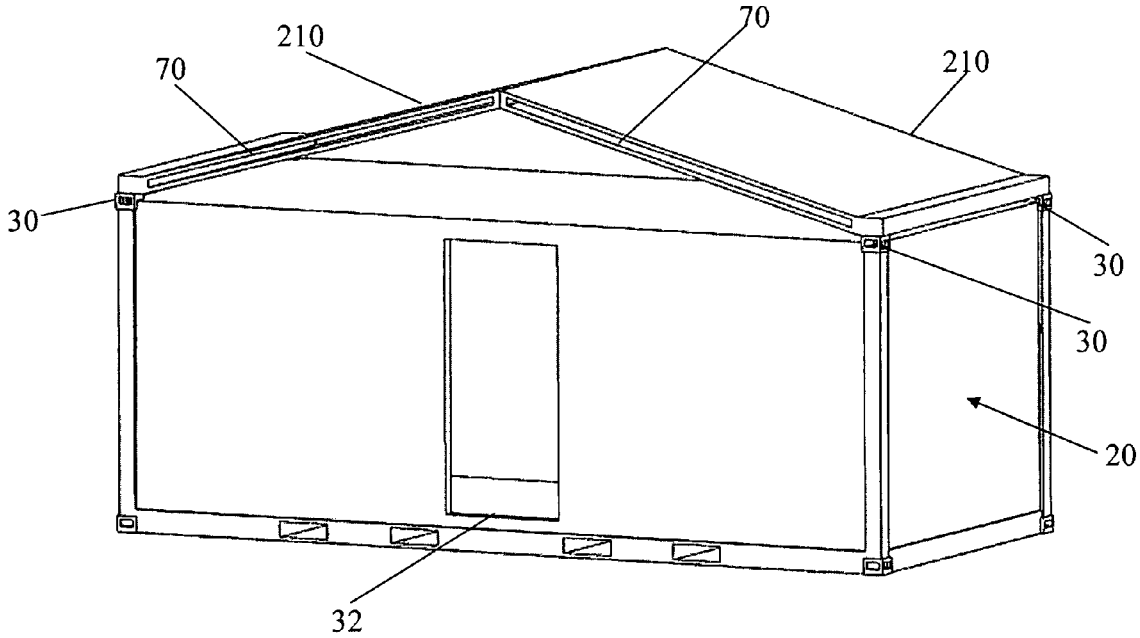
FIG. 19 shows one embodiment of inclined roof panels on an ISO container.
Figure 20:
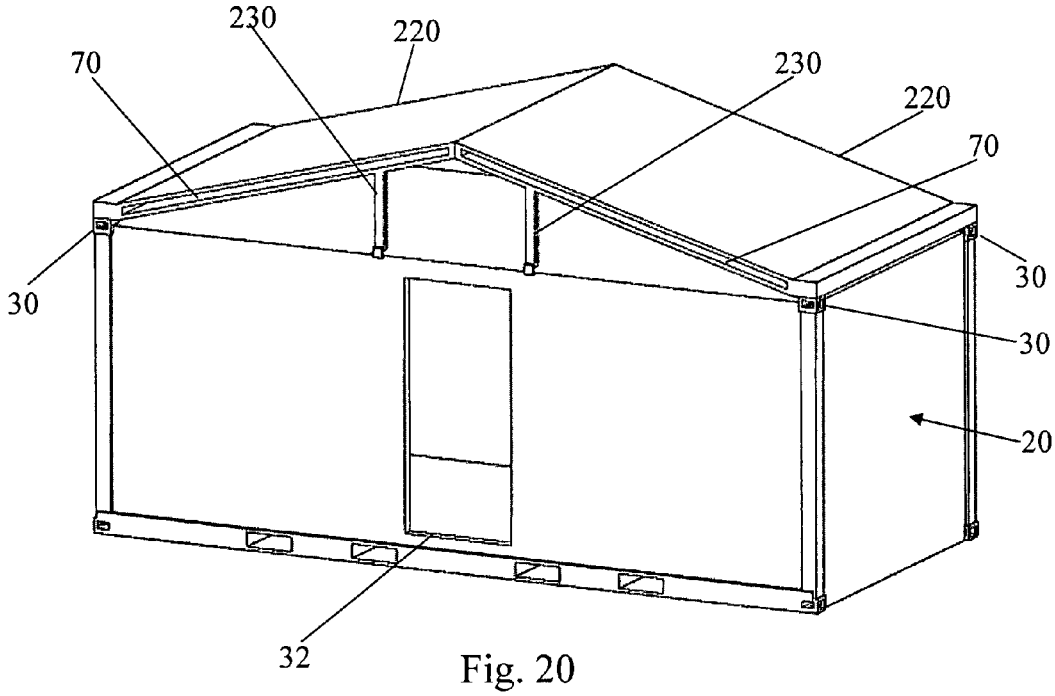
FIG. 20 shows another embodiment of inclined roof panels on an ISO container.
Figure 21:
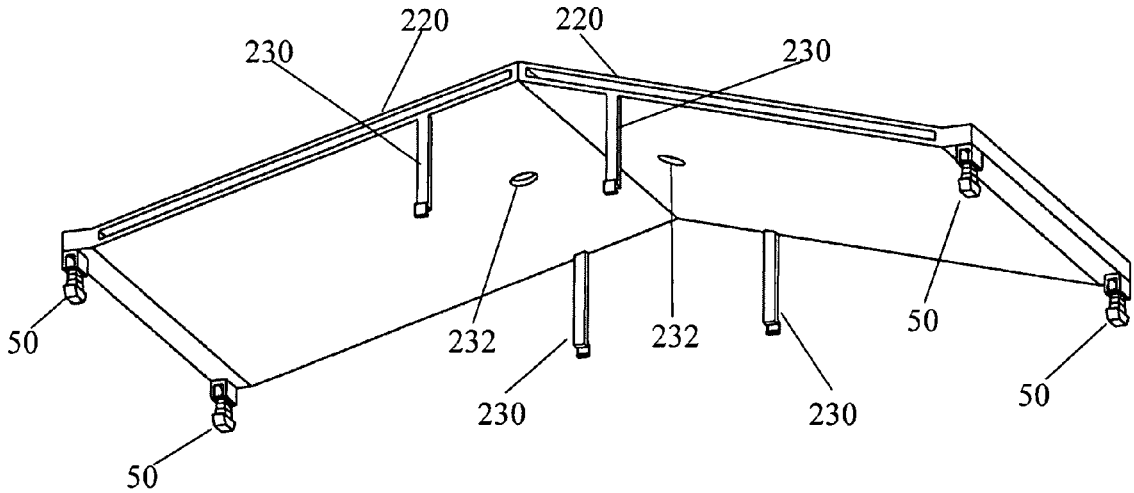
FIG. 21 shows details of one embodiment of an inclined roof panel with support structures and a vent hole.
Figure 22:
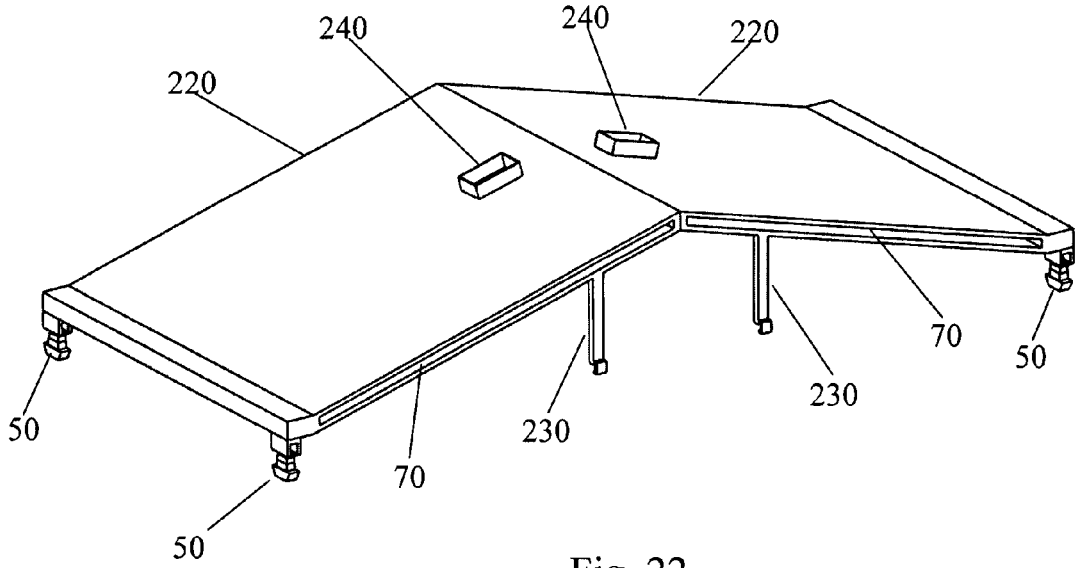
FIG. 22 shows one embodiment of an inclined roof panel with a chimney structure.
Figure 23:
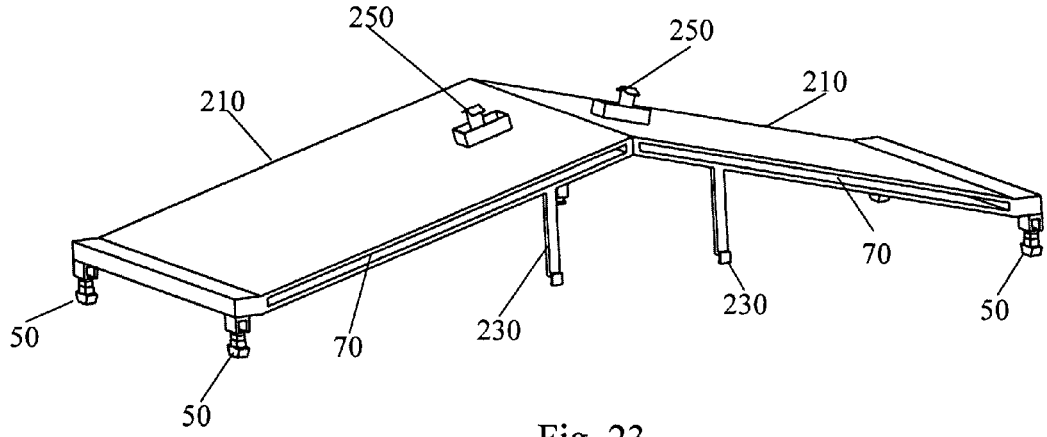
FIG. 23 shows one embodiment of an inclined roof panel with an extendable chimney structure.

In yet another embodiment, the roof panels 210 and 220 may be inclined at an angle with respect to the ISO container roof upper surface 25 as illustrated in FIG. 19 and FIG. 20, respectively. When the roof panels 210 and 220 are exposed to direct sunlight, the inclined roof panels induce natural heat convection currents to flow from the end of the roof panel 210 attached to the ISO container 20 towards the apex of the adjoining roof panels. In another embodiment, a chimney 240 is positioned at or near the apex of the adjoining panels to assist in ventilation. A vent hole 232 passing through the roof panel 220 provides air flow into the chimney 240. See FIG. 21 and FIG. 22. One embodiment uses a collapsible chimney 250 for space savings (FIG. 23). A plurality of roof panel support braces 230 between the roof panel and the ISO container roof may be installed to enhance the structural integrity or stability of the roof panels 220. The roof panel braces 230 fasten to the roof panel 220 and the ISO container 20.

Figure 24:
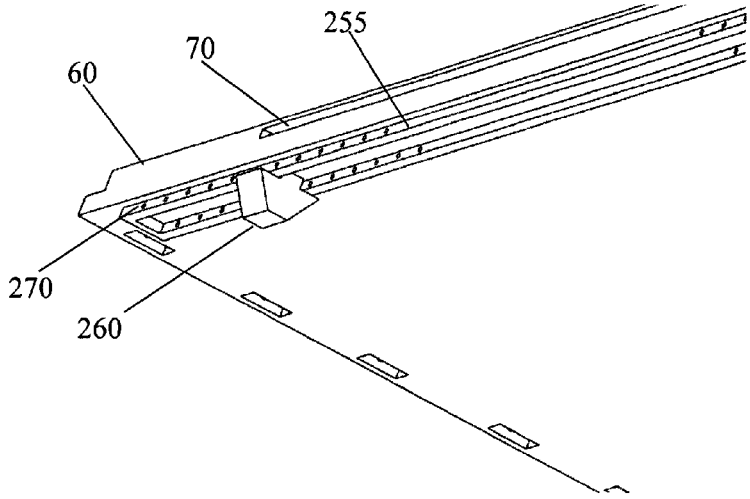
FIG. 24 shows a track positioned at the edge of a roof panel to permit position adjustment and locking of roof anchors along the length of the roof panel.

In at least one embodiment, the roof panels 60 are equipped with longitudinally positionable roof panel anchors 260 as shown in FIG. 24. A guide track 255 located near the longitudinal edges of the lower surface of the roof panel 60 allows the roof panel anchors 260 to be positioned where appropriate to mount into corner fittings 30. The roof panel anchors 260 may be locked in a desired location along the guide track 255 by set screws, locking pins into holes 270, spring loaded tabs, or other direct engagement or friction inducing locking mechanisms.

It is understood that thermal protection includes, but is not limited to, providing at least partial shade from solar radiation normally incident upon the ISO container 20, providing a thermal barrier to reduce heat loss from the ISO container 20, and providing a thermally insulating air gap between the ISO container roof upper surface 25 and the roof panel 60. The roof panels 60 may be in direct contact with the roof of the ISO container 20 in one embodiment and may be maintained at an adjustable standoff distance 27 in another embodiment.

Thermal protection by a particular roof panel may protect an ISO container directly or it may protect another roof panel when the panels are layered above the container thereby indirectly protecting the container.

The various embodiments described within are merely descriptions and are in no way intended to limit the scope of the invention. Modifications of the present invention will become obvious to one skilled in the art in light of the above descriptions and such modifications are intended to fall within the scope of the appended claims. It is understood that no limitation with respect to the specific apparatus illustrated herein is intended or should be inferred.

We claim:

1. A method of thermally protecting an ISO container having a roof comprising the steps of:

positioning a rigid roof panel above the roof of the ISO container thereby creating a standoff distance between the roof and the roof panel;

attaching the roof panel to at least one corner fitting on the roof of the container comprising a rectangular box with top and side openings to receive a complementary anchor having engaging portions to mate with the side openings of the corner fitting;

interlocking a plurality of roof panels to form a larger, composite roof panel;

adjusting the standoff distance between the roof and the roof panel; and coating at least one surface of the roof panel with a highly reflective material.

2. The method of claim 1 further comprising:

receiving solar energy to produce electrical power to drive a fan to force ambient air between the roof and roof panel.

3. The method of claim 1 further comprising:

inserting thermal insulation material into at least one cavity within the roof panel.

4. A thermally insulating roof panel system comprising:

a first and a second roof panel each comprising an upper surface, a lower surface, four edges, four corners, and at least one internal cavity;

the upper surface is coated with a highly reflective material;

insulation material may be inserted into the internal cavity to augment the thermal insulating properties of the panels;

at least one edge of the first roof panel comprises an interlocking pattern to mate with the edge of a second roof panel to form a larger, co-planar, composite roof panel;

attached to near at least one corner of the composite roof panel is a roof panel anchor to removably attach the composite roof panel to an ISO container to be thermally protected having a roof and at least one permanently installed corner fitting comprising a rectangular box with top and side openings to receive a complementary anchor having engaging portions to mate with the side openings of the corner fitting whereby the composite roof panel is positioned above the roof of the ISO container;

a standoff distance is maintained between the ISO container roof and the composite roof pane; and at least one roof panel anchor receptacle fixed to the upper surface of at least one of the first or second roof panels comprising the composite roof panel to removably engage a complementary anchor attached to a bottom surface of a third roof panel positioned above the composite roof panel.

5. The thermally insulating roof panel of claim 4 whereby the lower surface is coated with a low emissivity material.

6. The thermally insulating roof panel of claim 4 is comprised of material selected from the group including plastic, metal, fiber reinforced composite material, wood products and wood by-products, polymers, and recycled materials.

7. The thermally insulating roof panel of claim 4 further comprising at least one solar panel on the upper surface to produce electrical power to drive a fan.

* * * * *